US012601573B2

(12) United States Patent
Biedermann et al.

(10) Patent No.: US 12,601,573 B2
(45) Date of Patent: Apr. 14, 2026

(54) METHOD AND TOOL FOR PRODUCING A BASE PIECE OF A MULTI-PART CARTRIDGE CASE, BASE PIECE AND CARTRIDGE CASE

(71) Applicant: RUAG Ammotec AG, Thun (CH)

(72) Inventors: Peter Biedermann, Lyss (CH); Fabian Gloor, Ersigen (CH)

(73) Assignee: RUAG Ammotec AG, Thun (CH)

( * ) Notice: Subject to any disclaimer, the term of this patent is extended or adjusted under 35 U.S.C. 154(b) by 0 days.

(21) Appl. No.: 18/693,760

(22) PCT Filed: Sep. 15, 2022

(86) PCT No.: PCT/EP2022/075605
§ 371 (c)(1),
(2) Date: Mar. 20, 2024

(87) PCT Pub. No.: WO2023/046559
PCT Pub. Date: Mar. 30, 2023

(65) Prior Publication Data

US 2024/0377172 A1 Nov. 14, 2024

(30) Foreign Application Priority Data

Sep. 21, 2021 (DE) ..... 10 2021 124 431.5

(51) Int. Cl.
*F42B 5/285* (2006.01)
*B21K 21/14* (2006.01)
(Continued)

(52) U.S. Cl.
CPC ..... *F42B 5/285* (2013.01); *B21K 21/14* (2013.01); *F42B 33/001* (2013.01); *F42C 19/083* (2013.01)

(58) Field of Classification Search
CPC .... F42B 5/025; F42B 5/26; F42B 5/28; F42B 5/285; F42B 33/00; F42B 33/001;
(Continued)

(56) References Cited

U.S. PATENT DOCUMENTS

2015/0174643 A1 6/2015 Hay et al.
2015/0241183 A1 8/2015 Padgett et al.
2020/0158480 A1 5/2020 Routhier et al.
2020/0182594 A1 6/2020 Imhoff et al.
(Continued)

FOREIGN PATENT DOCUMENTS

DE 700207 C 12/1940
DE 732984 C 3/1943
(Continued)

OTHER PUBLICATIONS

English translation of Opinion in PCT/EP2022/075605 (Year: 2023).*
(Continued)

*Primary Examiner* — James S Bergin
(74) *Attorney, Agent, or Firm* — Banner & Witcoff, Ltd.

(57) ABSTRACT

A method for producing a base piece for receiving a primer for a multi-part cartridge case may include producing (e.g., by deforming) an extraction groove for engagement by a firearm ejector. The production of the extraction groove may be before a receptacle for a case jacket of the multi-part cartridge case for receiving a projectile is produced, such as by deforming. A tool arrangement for producing a base piece may be used to produce the base piece.

20 Claims, 11 Drawing Sheets

Figure 1:
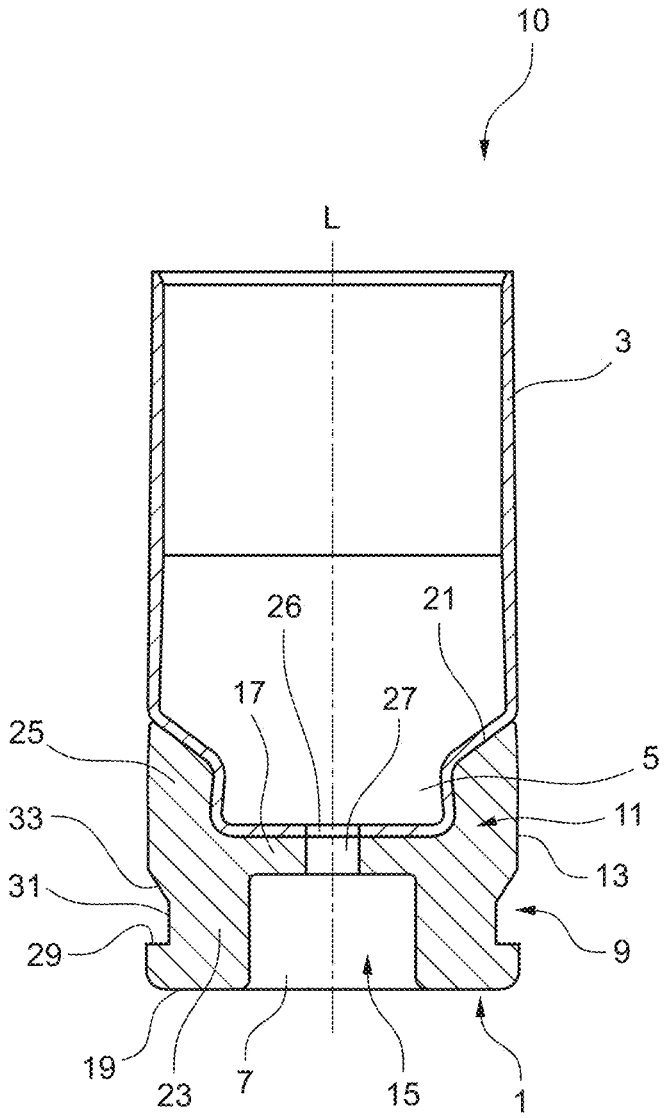
Figure 10:
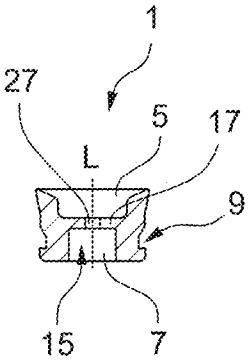
Figure 9:
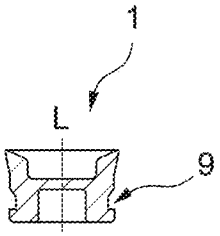

(51) Int. Cl.
*F42B 33/00* (2006.01)
*F42C 19/08* (2006.01)

(58) Field of Classification Search
CPC ..... B21K 21/04; B21K 21/12; B21K 21/14; F42C 19/083
USPC ..... 102/464, 469, 470
See application file for complete search history.

(56) References Cited

U.S. PATENT DOCUMENTS

| | | | | |
|---|---|---|---|---|
| 2023/0124564 | A1* | 4/2023 | Wosch | B21K 21/04 102/470 |
| 2023/0366661 | A1* | 11/2023 | Biedermann | F42B 33/001 |
| 2023/0384065 | A1* | 11/2023 | Biedermann | F42B 5/285 |

FOREIGN PATENT DOCUMENTS

| | | | |
|---|---|---|---|
| DE | 4229559 | A1 | 3/1994 |
| EP | 2690391 | A1 | 1/2014 |
| EP | 2789411 | A1 | 10/2014 |
| WO | 2020214136 | A1 | 10/2020 |

OTHER PUBLICATIONS

English translation of Search Report in PCT/EP2022/075605 (Year: 2023).*

May 2, 2023 (PCT) International Search Report and Written Opinion—App. PCT/EP2022/075605 (with translation).

May 16, 2022 (DE) Office Action—App. 102021124431.5.

* cited by examiner

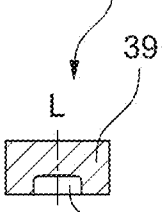
Fig. 2
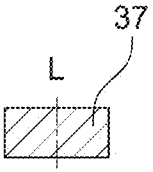
Fig. 3
Fig. 4
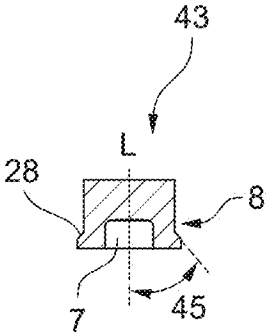
Fig. 5

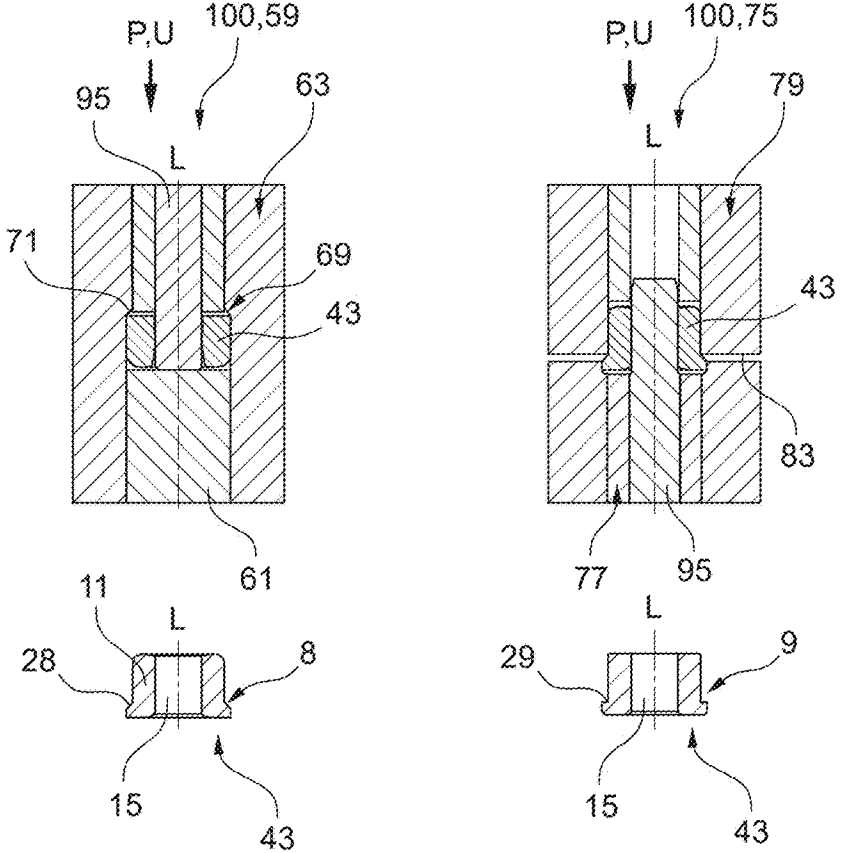
Fig. 23
Fig. 24
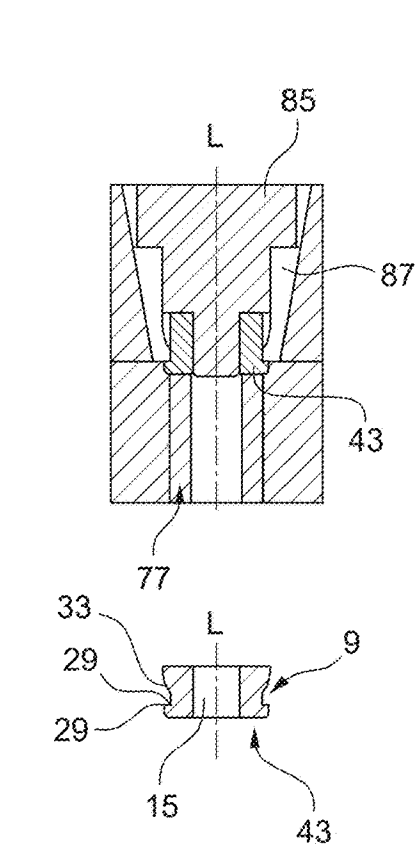
Fig. 25
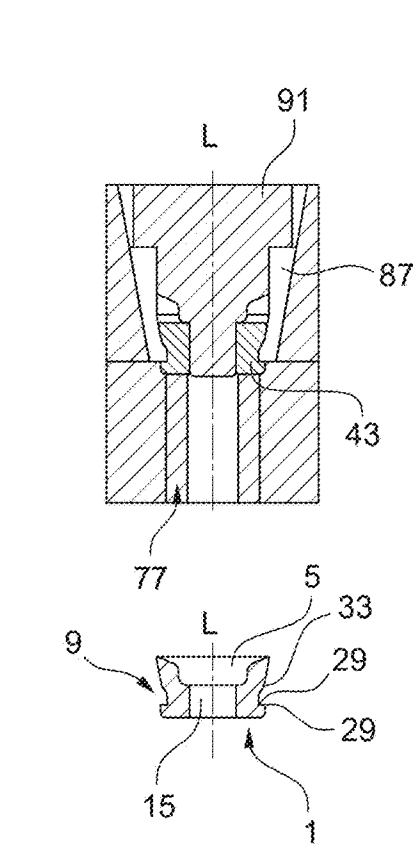
Fig. 26

METHOD AND TOOL FOR PRODUCING A BASE PIECE OF A MULTI-PART CARTRIDGE CASE, BASE PIECE AND CARTRIDGE CASE

CROSS REFERENCE TO RELATED APPLICATIONS

This patent application is a U.S. National Stage application of International Application No. PCT/EP2022/075605, filed Sep. 15, 2022, which claims priority to German Patent Application No. 10 2021 124 431.5, filed Sep. 21, 2021, each of which is incorporated herein by reference in its entirety.

BACKGROUND

Field

The present disclosure relates to a method and a tool arrangement for producing a base piece of a multi-part cartridge case. Furthermore, the present disclosure relates to a base piece for a multi-part cartridge case and to a multi-part cartridge case.

Related Art

Multi-part cartridge cases are basically known and are subdivided at least into a base piece facing the primer for receiving a primer and a case jacket firmly connected to the base piece for receiving a projectile. The base piece usually has an extraction groove to support the ejection of a fired, empty cartridge case. Via the extractor groove, a so-called extractor of a firearm can transport the empty cartridge case to a so-called ejector of the firearm, which finally ejects the empty cartridge case. The extraction groove is formed on a circumferential wall of the annular base piece as a circumferential groove or recess, which has a rear step edge oriented essentially transversely to the longitudinal axis direction, a radially inner side base surface oriented essentially in the longitudinal axis direction and a transition edge adjacent to the base surface and inclined in relation to the longitudinal axis direction. Conventionally, the extraction groove has so far been produced by machining, which has not proven to be optimal in terms of manufacturing costs and favorable mass production. In the domain of the production of one-piece cartridge cases, conventionally methods include manufacturing the extractor groove by deforming. So-called segmented punch and die tool arrangements are used here, by means of which the internal geometry for holding the projectile and the primer is first produced and finished and then the extraction groove is introduced on the outside in a subsequent process step. These punch and die tool arrangements cannot be easily transferred to multi-part cartridge cases.

For example, FR 1113479 discloses a 3-part cartridge case consisting of a base piece with an extraction groove, a case jacket and a fastening part. Another multi-part cartridge case is known from US 2019/0226817, in which the base piece also comprises an extraction groove.

The inventors of the present disclosure have identified considerable potential for improvement with regard to the extraction groove, namely on the one hand with regard to manufacturing tolerances and on the other hand with regard to achievable holding forces for fastening the base piece and case jacket together. It was found that it is not always possible to reliably ensure that the holding force of the base piece and case jacket of multi-part cartridge cases can withstand the considerable forces when firing a firearm. The desired manufacturing tolerances cannot be reliably ensured either with machining production or with previous solutions for cold-forming production of the extraction groove. In particular, when using segmented tools to produce the extraction groove, it has been found to be particularly disadvantageous that the segmented tools can produce surface defects in the portion of the extraction groove, which have a detrimental effect on the extraction function.

BRIEF DESCRIPTION OF THE DRAWINGS/FIGURES

The accompanying drawings, which are incorporated herein and form a part of the specification, illustrate the embodiments of the present disclosure and, together with the description, further serve to explain the principles of the embodiments and to enable a person skilled in the pertinent art to make and use the embodiments.

FIG. 1: a sectional view of an exemplary embodiment of a cartridge case according to the disclosure.

FIGS. 2 to 10: a schematic representation of a production sequence of a base piece according to the disclosure.

FIGS. 11 to 18: a schematic representation of the production sequence from FIGS. 2 to 10 in a tool arrangement according to the disclosure.

FIGS. 19 to 26: a schematic representation of an alternative production sequence in an exemplary embodiment of a tool arrangement according to the disclosure.

Figure 27:
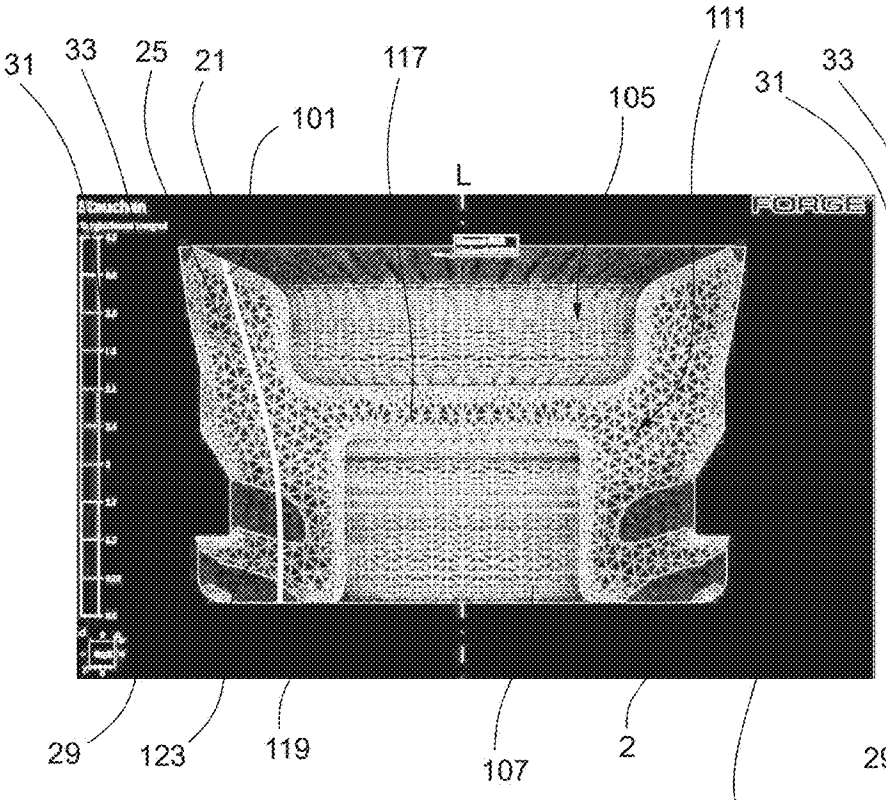
Fig. 27 (related art)

FIG. 27: a simulation of the degree of forming of a conventional base piece.

Figure 28:
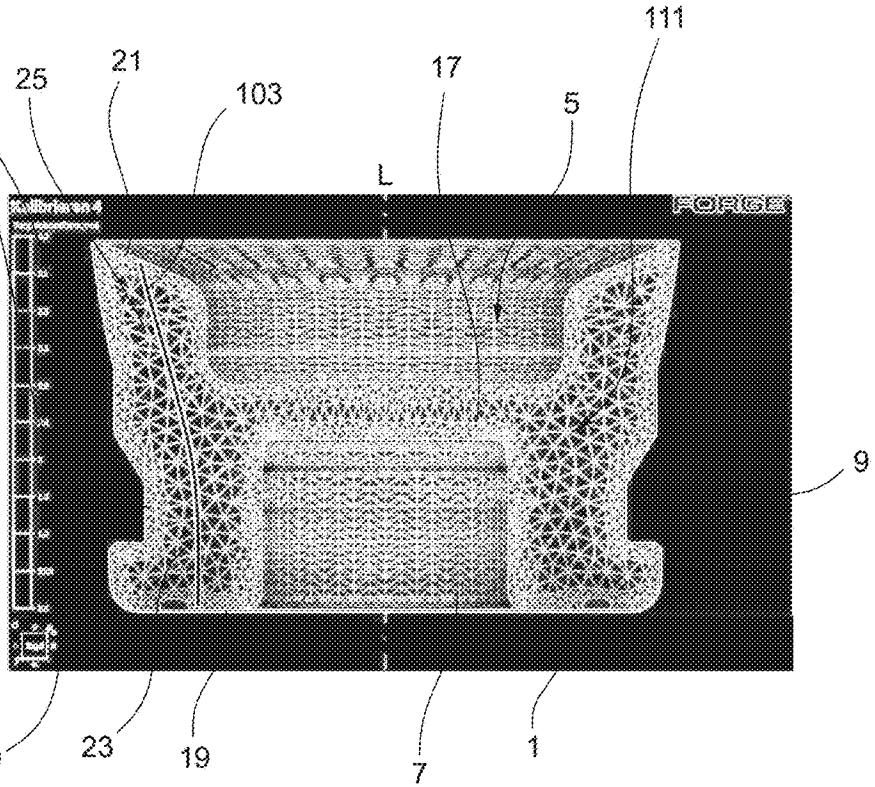

FIG. 28: a simulation of the degree of deformation of a base piece according to the disclosure.

Figure 29:
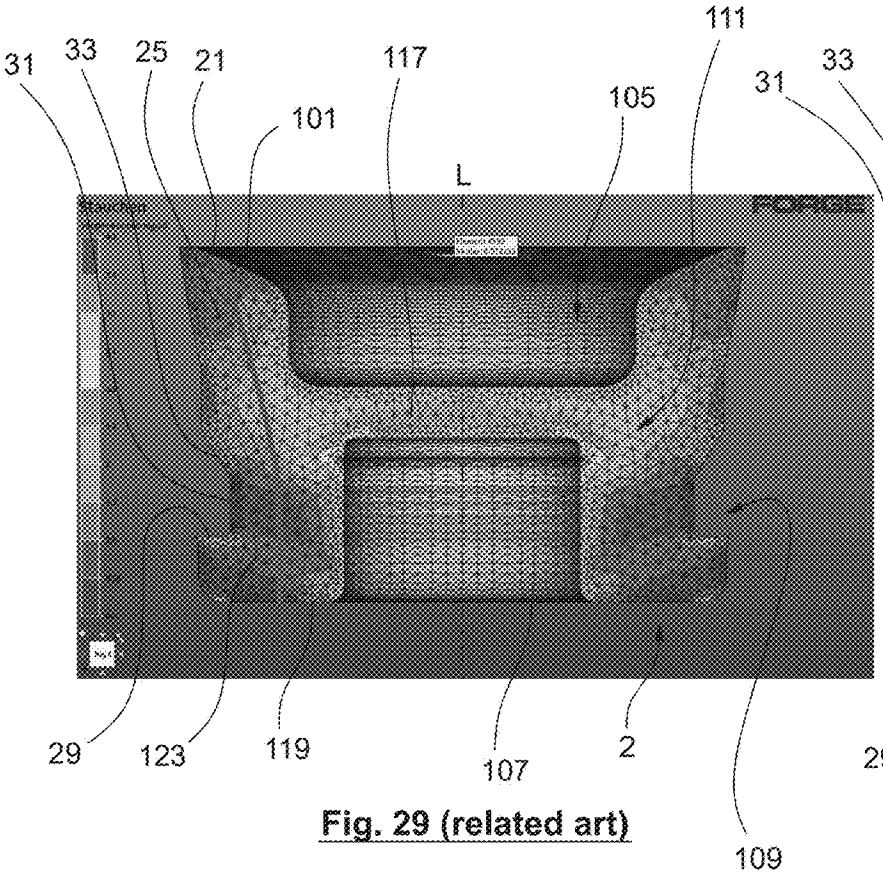
Fig. 29 (related art)

FIG. 29: a simulation of the degree of deformation of a conventional base piece.

Figure 30:
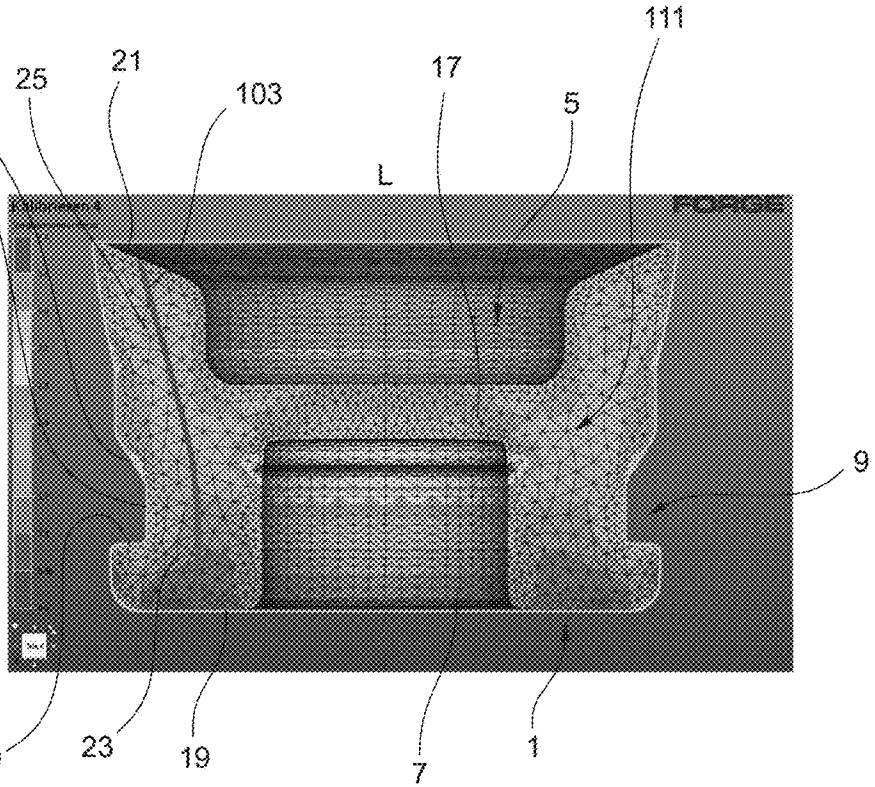

FIG. 30: a simulation of the degree of deformation of a base piece according to the disclosure.

Figure 31:
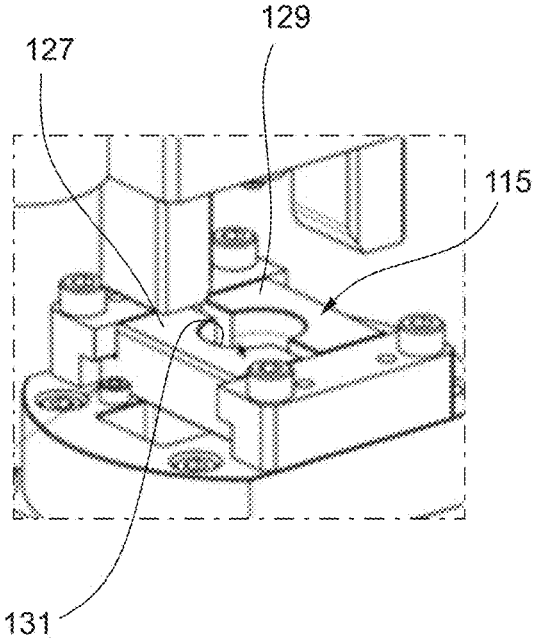

FIG. 31 a perspective view of an exemplary embodiment of a tool arrangement according to the disclosure.

Figure 32:
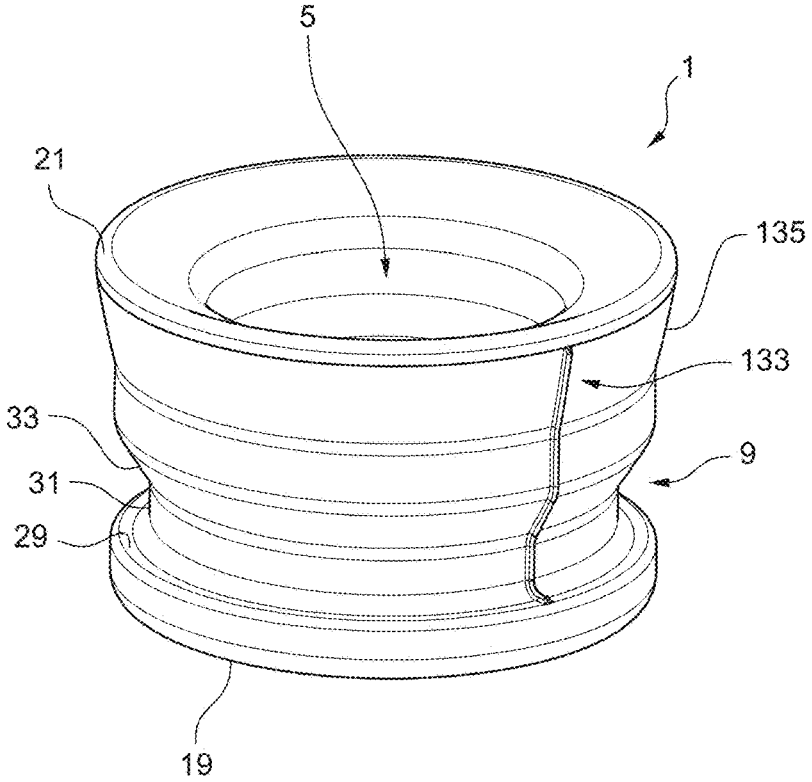

FIG. 32 a perspective view of an exemplary embodiment of a base piece according to the disclosure.

Figure 33:
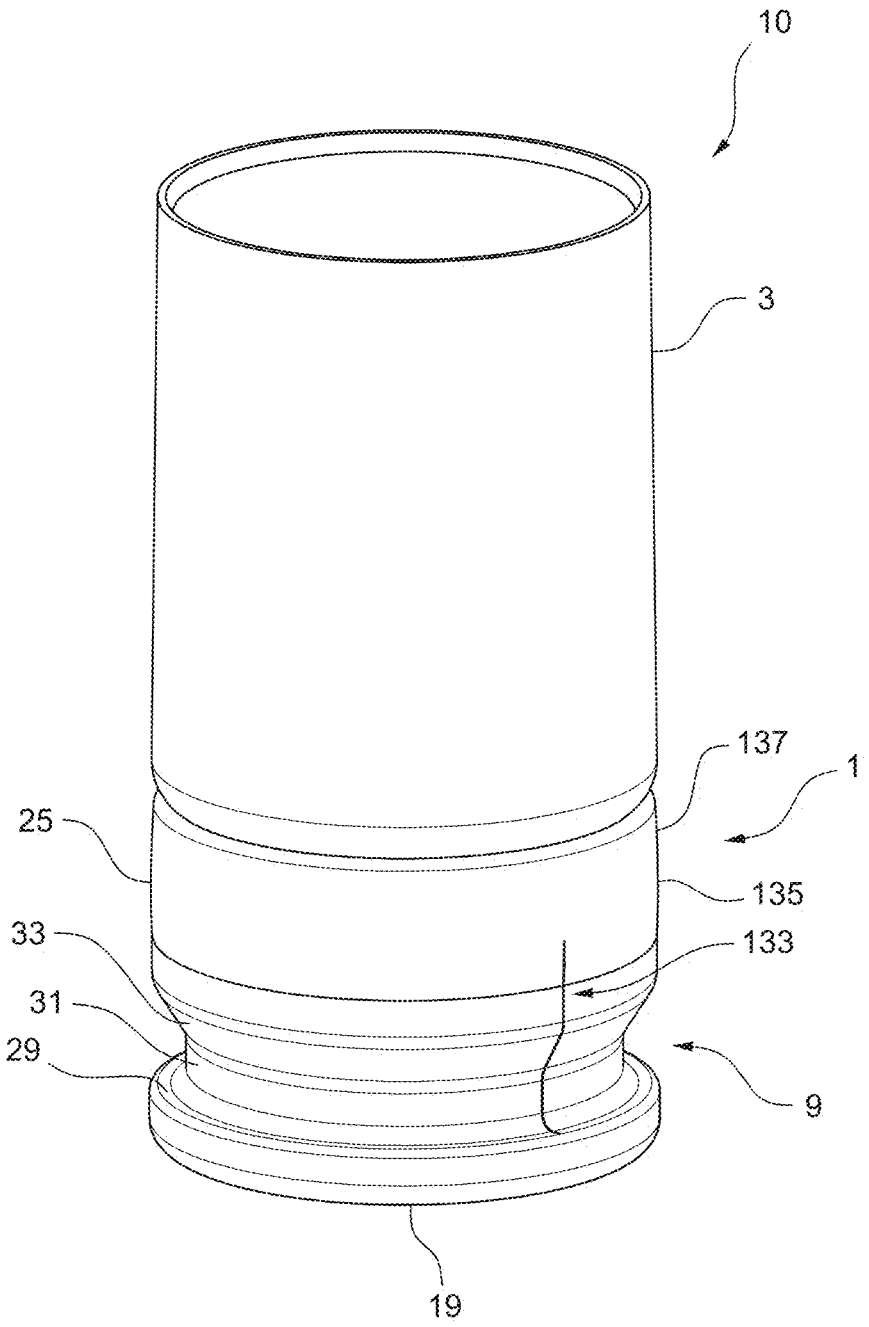

FIG. 33 a perspective view of an exemplary embodiment of a cartridge case according to the disclosure.

The exemplary embodiments of the present disclosure will be described with reference to the accompanying drawings. Elements, features and components that are identical, functionally identical and have the same effect are—insofar as is not stated otherwise—respectively provided with the same reference character.

DETAILED DESCRIPTION

In the following description, numerous specific details are set forth in order to provide a thorough understanding of the embodiments of the present disclosure.

An object of the disclosure is to overcome the disadvantages of the prior art, in particular to create a base piece for a multi-part cartridge case that is easy and inexpensive to manufacture, by means of which higher holding forces can be achieved between the base piece and the case jacket and/or the extractor groove of which can be manufactured with lower manufacturing tolerances.

Accordingly, a method for manufacturing a base piece for receiving a primer for a multi-part cartridge case is provided. It may be provided that the method is used to manufacture a base piece formed in accordance with one of the aspects or exemplary embodiments of the present disclosure described below. Ammunition, also referred to as a cartridge, generally comprises the following components: a cartridge case; a primer for igniting the propellant powder; a propellant charge as an energy carrier; and a projectile to be fired from a firearm. Multi-part cartridge cases generally comprise at least one base piece facing the primer for receiving the primer and a case jacket firmly connected to the base piece for receiving the projectile. When the case jacket and base piece are attached to one another, an outer side of the case jacket can rest against an inner side of the base piece; in other words, the base piece can at least partially receive the case jacket.

According to the disclosure, in the method for manufacturing a base piece, an extraction groove for engagement by a firearm ejector is produced by forming or shaping, in particular by cold forming, before a receptacle for the case jacket of the multi-part cartridge case for receiving a projectile is produced. The receptacle for the case jacket can also be manufactured by forming or shaping, in particular by cold forming, and can, for example, be formed as a central recess in the base piece. Deforming is generally a non-cutting manufacturing process in which the base piece is brought into a different shape without removing or adding material from the base piece. The mass of the base piece remains the same during deforming. A cold forming process, such as impact extrusion, can be used to deform the extraction groove and/or the receptacle of the case jacket. During deforming, the material of the base piece characteristically hardens, so that the base piece has a higher strength and/or a higher hardness after deforming, at least in the deformed portions, i.e. in the portion of the extraction groove and possibly in the portion of the receptacle for the case jacket. Due to the higher strength and/or the higher hardness, higher holding forces can be achieved between the base piece and the case jacket and/or between the base piece and the primer. As a result, a cartridge case with a base piece manufactured using the method according to the disclosure can withstand greater internal pressures when the projectile is fired. In addition, because the extraction groove is deformed before the receptacle for the case jacket is manufactured, simpler and less expensive tools can be used to manufacture the extraction groove. A further advantage of the method according to the disclosure is that the dimensional accuracy of the extraction groove during deforming is higher and can be ensured more reliably because the tools used for deforming the extraction groove do not produce any surface defects in the portion of the extraction groove, as can occur, for example, with segmented tools used in the prior art. These surface defects can have a negative influence on the extraction function, so that a base piece produced using the method according to the disclosure has a more reliable extraction function. By manufacturing the receptacle after deforming the extraction groove, it can also be ensured that the high dimensional accuracy and the higher hardness or higher strength are not impaired by the manufacturing of the receptacle.

In an exemplary embodiment of the method according to the disclosure, the extraction groove is already completed before production of the receptacle begins. In this way, it can be ensured that the dimensional accuracy of the extraction groove and the strength and/or hardness of the base piece are ensured independently of the production of the receptacle for the case jacket and/or are not impaired by a simultaneous or prior production of the receptacle.

In a further exemplary embodiment of the present disclosure, the extraction groove is not interfered with during manufacture of the receptacle. In this way, it can be ensured that the dimensional accuracy of the extraction groove and the strength and/or hardness of the base piece are not impaired after the extraction groove has been deformed, for example by segmented tools which can be used to manufacture the receptacle and which can produce surface defects or elevations in the extraction groove which can impair the extraction function.

According to a further aspect of the present disclosure, which may be combined with the preceding aspects and exemplary embodiments, there is provided a method of manufacturing a base piece for receiving a primer for a multi-part cartridge case. It may be provided that the method is used to manufacture a base piece formed according to one of the aspects or exemplary embodiments of the present disclosure described below. Ammunition, also referred to as a cartridge, generally comprises the following components: a cartridge case; a primer for igniting the propellant powder; a propellant charge as an energy carrier; and a projectile to be fired from a firearm. Multi-part cartridge cases generally comprise at least one base piece facing the primer for receiving the primer and a case jacket firmly connected to the base piece for receiving the projectile. When the case jacket and base piece are attached to one another, an outer side of the case jacket can rest against an inner side of the base piece; in other words, the base piece can at least partially receive the case jacket. For example, the base piece can have a central recess to receive the case jacket.

In the method according to the disclosure, an extraction groove for engagement by a firearm ejector is produced by deforming, in particular cold forming, in such a way that a primer-side groove flank of the extraction groove is formed by a material displacement directed in the longitudinal direction of the base piece without material being displaced radially outwards. Deforming is generally a non-cutting manufacturing process in which the base piece is brought into a different shape without removing or adding material from the base piece. The mass of the base piece remains the same during deforming. The primer-side groove flank of the extraction groove can be oriented transversely, in particular perpendicularly, to the longitudinal direction of the base piece. The firearm ejector can grip and eject the empty cartridge case after firing the projectile via the extraction groove or the primer-side groove flank. The primer-side groove flank can be the most important point for a reliable extraction function. By deforming the groove flank in accordance with the disclosure, the groove flank is produced directly by axial material deformation without the outer diameter of the base piece increasing during deformation of the extraction groove due to a radial outward displacement of the material. In the portions where material is displaced, the diameter of the base piece can be smaller after deforming the extraction groove than before deforming the extraction groove. As a result of such deforming, the material characteristically has a higher strength and/or a higher hardness on the one hand and, on the other hand, the deviations in strength and/or hardness are smaller; in other words, the strength curve and/or the hardness curve in the base piece is more homogeneous, particularly in the portion of the extraction groove and/or in the receptacle for the case jacket and/or the primer. It can thus be ensured more reliably that there is sufficient material strength and/or material hardness to ensure the necessary holding forces between the base piece and the case jacket and/or between the base piece and the primer. A further advantage of the method according to the disclosure is that the groove flank can be produced with greater dimensional accuracy and, in particular, the transition from the groove flank on the one hand to a jacket of the base piece and on the other hand to a groove base adjacent to the groove flank and oriented essentially in the longitudinal direction of the base piece can always be produced in the same way, for example as a sharp-edged shoulder, due to the material displacement directed in the longitudinal direction, and the empty cartridge case can thus be reliably ejected. In other words, the extraction groove or the primer-side groove flank has a higher dimensional accuracy, wherein the higher dimensional accuracy can also be ensured more reliably. A further advantage of the method according to the disclosure is that more cost-effective tools with a simpler structure can be used to produce the extraction groove, which additionally cannot produce surface defects in the portion of the extraction groove, in particular in the portion of the groove flank, which can impair the extraction function, as is the case with the conventional segmented tools.

In an exemplary embodiment of the present disclosure, the production of the extraction groove is accompanied by a flow of material in the opposite direction to the forming direction. In other words, there is a flow of material against the direction of movement of a tool used for deforming the extraction groove. In this way, it can be ensured that the material is not displaced outwards in a radial direction during deforming.

According to a further exemplary embodiment of a method according to the disclosure, the extraction groove is first preformed in such a way that a primer-side groove flank of the extraction groove is inclined at an angle of less than 90° with respect to the longitudinal direction of the base piece. It may be provided that the extraction groove is preformed by means of a pair of preforming punches and dies. In this way, the material does not have to be deformed as much initially, so that simpler and less expensive tools can be used.

In a further exemplary embodiment of a method according to the disclosure, the pre-formed extraction groove is further deformed by means of backwards extrusion. It may be provided that the extraction groove is further deformed by means of a second pair of punches and dies. Backwards extrusion is an extrusion process in which the material flow and the direction of punch movement are opposite. This means that the material flow is directed against the forming direction and against the movement of the forming tool. In this embodiment, the groove flank is only oriented at an angle of 90° transversely to the longitudinal direction of the base piece after further deforming. The two-stage production of the extraction groove means that simpler and more cost-effective tools can be used for the individual steps. It may also be provided that the die of the pair of preforming punches and dies is also used for the second step of further deforming the already preformed extraction groove in order to be able to deform the extraction groove more quickly and cost-effectively.

According to a further aspect of the present disclosure, which may be combined with the preceding aspects and exemplary embodiments, there is provided a method of manufacturing a base piece for receiving a primer for a multi-part cartridge case. It may be provided that the method is used to manufacture a base piece formed according to one of the aspects or exemplary embodiments of the present disclosure described below. Ammunition, also referred to as a cartridge, generally comprises the following components: a cartridge case; a primer for igniting the propellant powder; a propellant charge as an energy carrier; and a projectile to be fired from a firearm. Multi-part cartridge cases generally comprise at least one base piece facing the primer for receiving the primer and a case jacket firmly connected to the base piece for receiving the projectile. When the case jacket and base piece are attached to one another, an outer side of the case jacket can rest against an inner side of the base piece; in other words, the base piece can at least partially receive the case jacket. For example, the base piece can have a central recess to receive the case jacket.

According to the disclosure, in the method an extraction groove for engagement by a firearm ejector is manufactured by deforming, in particular cold forming, and without any post-machining. Deforming is generally a non-cutting manufacturing process in which the base piece is brought into a different shape without removing or adding material to the base piece. The mass of the base piece remains the same during deforming. Since no machining post-processing is required after deforming the extraction groove, the process according to the disclosure is simpler, faster and more cost-effective. In addition, a higher and more reliable dimensional accuracy of the extraction groove can be ensured.

In an exemplary embodiment, at least one manufacturing step for producing an inner and/or outer geometry of the base piece can be carried out by punching. This can significantly increase manufacturing efficiency. In particular, the manufacturing performance can be greatly improved so that the manufacturing costs can be significantly reduced, in particular by around 30%. This makes the manufacture of the cartridge cases much more suitable for mass and/or automated production. In an exemplary embodiment of the cartridge case, the base piece may comprise an annular jacket and a through hole extending through the jacket, in particular a receiving recess for the primer. The through hole can be produced at least sectionally by means of punching. In other words, an internal geometry of the base piece can be produced at least sectionally by means of punching.

According to a further aspect of the present disclosure, which can be combined with the preceding aspects and exemplary embodiments, there is provided a tool arrangement for introducing an extraction groove for engagement by a firearm ejector in a case blank for producing a base piece for receiving a primer for a multi-part cartridge case. The extraction groove allows the firearm ejector to grip and eject the empty cartridge case after the projectile has been fired. It may be provided that the tool arrangement is used to produce a base piece formed in accordance with one of the aspects or exemplary embodiments of the present disclosure described below. Ammunition, also referred to as a cartridge, generally comprises the following components: a cartridge case; a primer for igniting the propellant powder; a propellant charge as an energy carrier; and a projectile to be fired from a firearm. Multi-part cartridge cases generally comprise at least one base piece facing the primer for receiving the primer and a case jacket firmly connected to the base piece for receiving the projectile. When the case jacket and base piece are attached to one another, an outer side of the case jacket can rest against an inner side of the base piece; in other words, the base piece can at least partially receive the case jacket. For example, the base piece can have a central recess to receive the case jacket.

The tool arrangement can be adapted to perform a pressure forming process. According to the disclosure, the tool arrangement may comprise a particularly segmented die for fixing a face side of the case blank and for engaging in a case cavity of the case blank and a case-shaped press plunger for circumferentially engaging around the case blank. The die and/or the press plunger can be formed to be rotationally symmetrical. The case blank can, for example, be produced in a first step by setting a piece of wire or by punching it out of a plate. In a further step, the case cavity into which the die of the tool arrangement according to the disclosure engages during deforming can be produced, for example by extrusion. It may be provided that the case cavity forms the primer receptacle on the finished base piece.

According to an aspect of the present disclosure, the press plunger is movable relative to the die for deforming, in particular cold forming, the extraction groove. In particular, the press plunger can be movable strictly axially, in particular in the longitudinal direction of the base piece or the case blank, relative to the die. In other words, a purely translational movement of the press plunger can be provided to produce the extraction groove. The need for additional radial movability in segmented tools used in the prior art, in which individual segments of the segmented tool move radially towards each other for pressing or deforming, can be dispensed with. Compared to tools commonly used in the prior art, the tool arrangement according to the disclosure has a simpler structure and is therefore less expensive and less prone to errors. The tool arrangement according to the disclosure, and in particular the press plunger according to the disclosure, can also be used to produce the extraction groove without creating elevations or surface defects in the portion of the extraction groove between the individual segments of the tool, which can have a detrimental effect on the function of the firearm ejector and/or have to be subsequently removed by machining with additional effort and additional costs. By deforming the extraction groove with the tool arrangement according to the disclosure, a higher strength and/or a higher hardness of the base piece can also be achieved so that higher holding forces are created between the base piece and the case jacket and/or between the base piece and the primer. A further advantage of a tool tensioning arrangement according to the disclosure is that a more homogeneous hardness and/or strength curve can be achieved in the base piece.

It should be understood that the embodiments made with respect to a method for producing a base piece according to the disclosure apply analogously to the tool arrangement according to the disclosure.

In an exemplary embodiment of the present disclosure, the press plunger is circumferentially closed. Alternatively, or additionally, the press plunger is made from a single piece. Such a press plunger does not cause any unevenness or surface defects when producing the extraction groove, such as occur in the prior art when using segmented tools for deforming the extraction groove.

According to a further aspect of the present disclosure, which can be combined with the preceding aspects and exemplary embodiments, there is provided a tool arrangement for introducing an extraction groove for engagement by a firearm ejector in a case blank for producing a base piece for receiving a primer for a multi-part cartridge case. The extraction groove allows the firearm ejector to grip and eject the empty cartridge case after the projectile has been fired. It may be provided that the tool arrangement is used to produce a base piece formed in accordance with one of the aspects or exemplary embodiments of the present disclosure described below. Ammunition, also referred to as a cartridge, generally comprises the following components: a cartridge case; a primer for igniting the propellant powder; a propellant charge as an energy carrier; and a projectile to be fired from a firearm. Multi-part cartridge cases generally comprise at least one base piece facing the primer for receiving the primer and a case jacket firmly connected to the base piece for receiving the projectile. When the case jacket and base piece are attached to one another, an outer side of the case jacket can rest against an inner side of the base piece; in other words, the base piece can at least partially receive the case jacket. For example, the base piece can have a central recess to receive the case jacket.

The tool arrangement can be adapted to perform a pressure forming process. According to the disclosure, the tool arrangement may comprise a die for fixing a face side of the case blank and for engaging in a case cavity of the case blank and a press plunger for gripping around the outside of the case blank. The die and/or the press plunger can be formed to be rotationally symmetrical. The press plunger can be formed in a case-shaped manner. The case blank can, for example, be produced in a first step by setting a piece of wire or by punching it out of a plate. In a further step, the case cavity into which the die of the tool arrangement according to the disclosure engages during deforming can be produced, for example by extrusion. It may be provided that the case cavity forms the primer receptacle on the finished base piece.

According to an aspect of the present disclosure, the press plunger has a material displacement projection on its inner side facing the case blank, by means of which, during a pressing movement of the press plunger relative to the die, the tool arrangement forms a primer-side groove flank of the extraction groove for engagement by a firearm ejector. In particular, the pressing movement can be purely axial, especially in the longitudinal direction of the base piece or the case blank. It may be provided that the material displacement projection is formed radially circumferentially and/or planar, in particular without elevations or recesses. The material displacement projection can be oriented at an angle of 90° or at an angle of less than 90° in relation to the longitudinal direction of the base piece or the case blank. The material displacement projection can achieve a higher dimensional accuracy of the extraction groove and it can be ensured that no elevations or surface defects occur in the portion of the extraction groove that could impair the extraction function. It can also be ensured that the material is not displaced radially outwards during deforming. A further advantage of the tool arrangement according to the disclosure is that the extraction groove and in particular the groove flank can be produced with greater dimensional accuracy and in particular the transition from the groove flank on the one hand to a jacket of the base piece and on the other hand to a groove base adjacent to the groove flank and oriented essentially in the longitudinal direction of the base piece can always be produced in the same way, for example always as a sharp-edged shoulder, due to the material displacement directed in the longitudinal direction and the empty cartridge case can therefore be ejected more reliably. In other words, the extraction groove or the primer-side groove flank has a higher dimensional accuracy, wherein the higher dimensional accuracy can also be ensured more reliably.

It should be understood that the embodiments made with respect to a method for producing a base piece according to the disclosure apply analogously to the tool arrangement according to the disclosure.

In an exemplary embodiment of a tool arrangement according to the disclosure, the material displacement projection has a pressing surface inclined with respect to the direction of pressing movement. The direction of pressing movement can coincide with the longitudinal direction of the base piece or the case blank. In an exemplary further development, an angle of inclination of the material displacement projection is in the range from 10° to 80°, in particular in the range from 15° to 75°, in particular in the range from 20° to 70° or in the range from 25° to 65°. It may be provided that the extraction groove is preformed with the inclined pressing surface and the preformed extraction groove is then further deformed.

According to a further aspect of the present disclosure, which can be combined with the preceding aspects and exemplary embodiments, there is provided a tool arrangement for introducing an extraction groove for engagement by a firearm ejector into a case blank or into a base piece pre-stage for producing a base piece for receiving a primer for a multi-part cartridge case. The extraction groove allows the firearm ejector to grip and eject the empty cartridge case after the projectile has been fired. It may be provided that the tool arrangement is used to produce a base piece formed in accordance with one of the aspects or exemplary embodiments of the present disclosure described below. Ammunition, also referred to as a cartridge, generally comprises the following components: a cartridge case; a primer for igniting the propellant powder; a propellant charge as an energy carrier; and a projectile to be fired from a firearm. Multi-part cartridge cases generally comprise at least one base piece facing the primer for receiving the primer and a case jacket firmly connected to the base piece for receiving the projectile. When the case jacket and base piece are attached to one another, an outer side of the case jacket can rest against an inner side of the base piece; in other words, the base piece can at least partially receive the case jacket. For example, the base piece can have a central recess to receive the case jacket.

The tool arrangement can be adapted to perform a pressure forming process. The tool arrangement further may comprise a forming punch comprising at least two, in particular exactly two, punch parts for deforming the finished extraction groove, which are arranged for circumferentially gripping the case blank or the base piece pre-stage. The forming punch can be adapted to displace material from the case blank or the base piece pre-stage by means of a pressing movement in order to imprint or form the structure of the extraction groove. The punch parts, in particular the punch halves, can be movably mounted towards each other and/or formed identically. The punch parts can grip and/or clamp, in particular cold-form, the case blank or the base piece pre-stage in a pincer-like manner.

Furthermore, the tool arrangement according to the further aspect of the disclosure may comprise an anvil which can be moved translationally relative to the forming punch for fixing a face side opposite the face side of the case blank or the base piece pre-stage, which can be brought into abutment contact with the forming punch. For example, the anvil can have at least one operating state, in which it is brought into abutment contact with the forming punch, and another operating state, in particular a passive state, in which it is brought out of abutment contact with the forming punch. In particular, the anvil can translate between the punch parts, in particular the punch halves.

According to a further aspect of the disclosure, facing abutment contact surfaces of the forming punch and the anvil are shape-matched to one another. For example, the abutment contact surfaces can be shape-matched to one another in such a way that self-centering occurs during translational movement of the anvil relative to the forming punch, in particular in the direction of engaging the abutment contact.

In an exemplary embodiment of the tool arrangement according to the disclosure, the abutment contact surface of the forming punch is at least sectionally, in particular completely, concave in shape and/or the abutment contact surface of the anvil is at least sectionally, in particular completely, convex in shape. When the stop contact is made, there can be essentially full-surface abutment contact, wherein it is ensured in particular that a relative movement of the abutment and forming punch transversely to the translational direction of movement of the anvil is prevented. According to an exemplary further development, the abutment contact surface of the forming punch forms a concave receptacle for the anvil and the anvil essentially fills this receptacle completely. For example, the receptacle can have a semi-spherical shape and the anvil can have a shape-matched shape.

In an exemplary embodiment of the tool arrangement according to the disclosure, the anvil may comprise a central projection adjoining the abutment contact surface, which is arranged to engage in the receptacle for the case jacket of the multi-part cartridge case in order to retain the structure of the receptacle or the structure from which the receptacle is to be subsequently produced during the shaping of the extraction groove.

In a further exemplary embodiment of the present disclosure, the tool arrangement is adapted to generate a recognizable separation point with a dimension of up to 0.2 m, in particular 0.15 mm or about 0.1 mm, on the outside of the base piece. For this purpose, the punch parts can displace material of the base piece during pressing of the base piece and clamp it between them, resulting in a separation point or seam protruding from the outside of the base piece.

According to a further aspect of the present disclosure, which can be combined with the preceding aspects and exemplary embodiments, there is provided a base piece for receiving a primer for a multi-part cartridge case, which is produced by a method according to the disclosure and/or by a tool arrangement according to the disclosure.

According to a further aspect of the present disclosure, which can be combined with the preceding aspects and exemplary embodiments, a base piece for receiving a primer for a multi-part cartridge case is provided. The base piece may be produced by a method according to the disclosure and/or by a tool arrangement according to the disclosure. It should be understood that the foregoing embodiments and advantages of methods and tool arrangements according to the disclosure apply analogously to a base piece according to the disclosure. Ammunition, also referred to as a cartridge, generally comprises the following components: a cartridge case; a primer for igniting the propellant powder; a propellant charge as an energy carrier; and a projectile to be fired from a firearm. Multi-part cartridge cases generally comprise at least one base piece facing the primer for receiving the primer and a case jacket firmly connected to the base piece for receiving the projectile. When the case jacket and base piece are attached to one another, an outer side of the case jacket can rest against an inner side of the base piece; in other words, the base piece can at least partially receive the case jacket. For example, the base piece can have a central recess to receive the case jacket.

The base piece may comprise an annular jacket with a central priming bore and a receptacle opening into the priming bore for a case jacket of the multi-part cartridge case for receiving a projectile. The receptacle for the case jacket can open directly into the priming bore or be separated from the priming bore by a web. In this case, a through bore can be provided in the web in order to fluidly connect the priming bore with the receptacle. The base piece can be formed rotationally symmetrically and define an axis of rotation which is oriented in the longitudinal direction of the base piece.

According to an aspect of the present disclosure, the jacket has an extraction groove for engagement by a firearm ejector. Via the extraction groove, the firearm ejector can grip and eject the empty cartridge case after the projectile has been fired. The extraction groove has a primer-side groove flank oriented transversely, in particular perpendicularly, to the longitudinal direction of the base piece and a groove base opening into the primer-side groove flank and oriented essentially in the longitudinal direction of the base piece. According to the disclosure, the hardness of the jacket on the primer-side groove flank deviates from the hardness of the jacket on the groove base by less than 40%. Such a hardness profile can be produced, for example, by deforming the extraction groove and possibly the receptacle for the case jacket and the resulting degree of deformation of the material. The degree of deformation is the measure of the change in shape when producing the base piece according to the disclosure. The hardness of the material can, for example, depend directly on the degree of deformation. A hardness profile according to the disclosure is therefore characteristic of a deforming production of the extraction groove of the base piece. The Vickers hardness, for example, can be used as a measure of the hardness of the material.

In an exemplary embodiment of the present disclosure, the hardness of the jacket on the primer-side groove flank deviates from the hardness of the jacket on the groove base by less than 35%. In particular, the hardness of the jacket on the primer-side groove flank deviates from the hardness of the jacket on the groove base by less than 30%, less than 25%, less than 20%, less than 15% or less than 10%. In an exemplary further development, the hardness of the jacket on the primer-side groove flank essentially corresponds to the hardness of the jacket on the groove base. In the further development, there is thus a homogeneous hardness profile of the base piece in the portion of the extraction groove.

According to a further aspect of the present disclosure, which can be combined with the preceding aspects and exemplary embodiments, a base piece for receiving a primer for a multi-part cartridge case is provided. The base piece may be produced by a method according to the disclosure and/or by a tool arrangement according to the disclosure. It should be understood that the foregoing embodiments and advantages of methods and tool arrangements according to the disclosure apply analogously to a base piece according to the disclosure. Ammunition, also referred to as a cartridge, generally comprises the following components: a cartridge case; a primer for igniting the propellant powder; a propellant charge as an energy carrier; and a projectile to be fired from a firearm. Multi-part cartridge cases generally comprise at least one base piece facing the primer for receiving the primer and a case jacket firmly connected to the base piece for receiving the projectile. When the case jacket and base piece are attached to one another, an outer side of the case jacket can rest against an inner side of the base piece; in other words, the base piece can at least partially receive the case jacket. For example, the base piece can have a central recess to receive the case jacket.

The base piece may comprise an annular jacket which has a priming bore wall delimiting a priming bore extending through the jacket and a receptacle wall opening into the priming bore wall and forming a receptacle for a case jacket of the multi-part cartridge case for receiving a projectile. The base piece can be formed to be rotationally symmetrical and define an axis of rotation which is oriented in the longitudinal direction of the base piece. According to the disclosure, the hardness of a core section of 25% to 75% of the wall thickness of the receptacle wall and/or the priming bore wall does not decrease in the longitudinal direction of the base piece from a primer-side lower side of the base piece to a projectile-side upper side of the base piece. In an exemplary further development, the hardness of the core section remains at least constant or increases continuously. In other words, the base piece has a homogeneous hardness profile in the core section of the priming bore wall and/or the receptacle wall between the lower side on the primer side and the projectile-side upper side. The Vickers hardness, for example, can be used as a measure of the hardness of the material. Such a hardness profile is characteristic for producing the extraction groove by deforming. The hardness of the material can, for example, depend directly on the degree of deformation of the material. The degree of deformation is the measure of the change in shape when producing the base piece according to the disclosure.

According to a further aspect of the present disclosure, which can be combined with the preceding aspects and exemplary embodiments, a base piece for receiving a primer for a multi-part cartridge case is provided. The base piece may be produced by a method according to the disclosure and/or by a tool arrangement according to the disclosure. It should be understood that the foregoing embodiments and advantages of methods and tool arrangements according to the disclosure apply analogously to a base piece according to the disclosure. Ammunition, also referred to as a cartridge, generally comprises the following components: a cartridge case; a primer for igniting the propellant powder; a propellant charge as an energy carrier; and a projectile to be fired from a firearm. Multi-part cartridge cases generally comprise at least one base piece facing the primer for receiving the primer and a case jacket firmly connected to the base piece for receiving the projectile. When the case jacket and base piece are attached to one another, an outer side of the case jacket can rest against an inner side of the base piece; in other words, the base piece can at least partially receive the case jacket. For example, the base piece can have a central recess to receive the case jacket.

The base piece may comprise an annular jacket with a central priming bore and a receptacle, opening into the priming bore, for a case jacket of the multi-part cartridge case for receiving a projectile. According to the disclosure, an extraction groove for engagement by a firearm ejector is introduced into the jacket by deforming, in particular cold forming, and without machining. The extraction groove allows the firearm ejector to grip and eject the empty cartridge case after the projectile has been fired. Conventionally, the extraction groove has to be machined after deforming, for example by machining off irregularities, which causes additional costs and additional effort. The deforming production of the extraction groove can be recognized on the finished base piece by the fact that there are no surface defects or elevations in the portion of the extraction groove and in particular in the region of a primer-side groove flank and the groove flank is thus formed particularly planar.

In an exemplary embodiment of a base piece according to the disclosure, the extraction groove is free of material flags in the circumferential direction. Material flags are to be understood as unevenness or elevations in the portion of the extraction groove, which, in conventional devices, occur when the extraction groove is produced with segmented tools due to the fact that when the individual segments of the tools move towards each other, displaced material from the base piece accumulates between them and ultimately remains on the base piece as a material flag in the region of the seam between two cooperating segments. A deviation of the diameter in the portion of the extraction groove at the same axial height can be less than 0.1 mm.

According to a further aspect of the present disclosure, which can be combined with the preceding aspects and exemplary embodiments, a cartridge case for ammunition is provided. For example, the ammunition has a caliber in the range from 4.6 to 12.7. Ammunition, also referred to as a cartridge, generally consists of the following components: a cartridge case; a primer for igniting the propellant powder; a propellant charge as an energy carrier; and a projectile to be fired from a firearm. Multi-part cartridge cases generally comprise at least one base piece facing the primer for receiving the primer and a case jacket firmly connected to the base piece for receiving the projectile. When the case jacket and base piece are attached to each other, an outer side of the case jacket can rest against an inner side of the base piece; in other words, the base piece can at least partially receive the case jacket. For example, the base piece may have a central recess.

According to the disclosure, the cartridge case may include a rotationally symmetrical case jacket and a base piece according to the disclosure attached thereto. It may be provided that a primer is inserted, in particular pressed into, the base piece.

In the following description of exemplary embodiments of the present disclosure, a base piece according to the disclosure for a multi-part cartridge case is generally provided with the reference numeral 1, a cartridge case according to the disclosure is generally provided with the reference numeral 10 and a tool arrangement according to the disclosure for producing a base piece is provided with the reference numeral 100.

FIG. 1 shows an exemplary embodiment of a cartridge case 10 according to the disclosure in a sectional view. The cartridge case 10 may include a base piece 1 and a case jacket 3 firmly connected thereto for receiving a projectile (not shown). In the embodiment shown in FIG. 1, the base piece 1 and the case jacket 3 are formed to be rotationally symmetrical. The case jacket 3 has a constant wall thickness and can be produced from metal, for example. The base piece 1 can also be made of metal or a metal alloy, for example copper, case-hardened steel or brass.

The base piece 1 has a central recess 5 for receiving the case jacket 3. Opposite the recess 5, the base piece 1 has a further central cylindrical recess 7 in which a primer (not shown) is received. In the following description, recess 5 is referred to as receptacle 5 and recess 7 is referred to as primer receptacle 7.

The base piece 1 also has a central priming bore 15, which is delimited by an annular jacket 11 of the base piece and opens into the receptacle 5 for the case jacket 3. In the embodiment shown in FIG. 1, a web 17 is formed between the receptacle 5 and the primer receptacle 7. The primer receptacle 7 extends from a primer-side lower side 19 of the base piece 1 in the direction of a projectile-side upper side 21 of the base piece 1 up to the web 17. The part of the jacket 11 that delimits the primer receptacle 7 is referred to below as the priming bore wall 23. The receptacle 5 for the case jacket 3 extends from the projectile-side upper side 21 in the direction of the primer-side lower side 19 of the base piece 1 to the web 17. The part of the jacket 11 that delimits the receptacle 5 for the case jacket 3 is referred to below as the receptacle wall 25. In the embodiment shown in FIG. 1, the web 17 has a central through bore 27 which fluidly connects the primer receptacle 7 and the receptacle 5. In the embodiment in FIG. 1, the priming bore 15 is thus formed by the primer receptacle 7 and the through bore 27.

The web 17 can prevent unintentional separation of the receptacle wall 25 from the priming bore wall 23 when the projectile is fired. In a further embodiment of a base piece 1 according to the disclosure (see FIG. 26), the receptacle 5 can open directly into the primer receptacle 7 without a web being provided therebetween as in FIG. 1. In this embodiment, the priming bore 15 is formed only by the primer receptacle 7. In both embodiments, the case jacket 3 has a corresponding through bore 26 on a side facing the base piece 1 in order to be able to transfer the force generated by the primer to the projectile for firing the projectile.

The base piece 1 may also include an extraction groove, which in the following is generally provided with the reference numeral 9. The extraction groove 9 is introduced into an outer side 13 of the annular jacket 11 of the base piece 1 and runs completely around the base piece 1 in the circumferential direction. A firearm ejector can grip and eject the empty cartridge case 10 via the extraction groove 9 after the projectile has been fired. The extraction groove 9 may comprise a primer-side groove flank 29, which is oriented essentially perpendicular to the longitudinal direction L of the base piece 1, a radially inner-side groove base 31 oriented essentially in the longitudinal direction L and a transition edge 33 adjoining the groove base 31 and inclined with respect to the longitudinal direction L. To eject an empty cartridge case 10, the firearm ejector engages in the primer-side groove flank 29, which is thus the most important point for reliable ejection. The extraction groove 9 or the groove flank 29 is free of material flags in the circumferential direction. Material flags are unevennesses or elevations in the portion of the extraction groove 9 or the groove flank 29. With conventional techniques, material flags occur between the individual segments of the tool when producing the extraction groove with segmented tools. A deviation of the diameter in the portion of the extraction groove 9 at the same axial height is less than 0.1 mm in a base piece 1 according to the disclosure, the dimensional accuracy of the extraction groove 9 is thus particularly high in a base piece 1 according to the disclosure. The groove flank 29, the groove base 31 and the transition edge 33 are thus formed particularly planar in a base piece 1 according to the disclosure, in particular without elevations or surface defects, so that no post-machining is necessary. Such an extraction groove 9 can be produced by a method according to the disclosure for introducing an extraction groove 9 into a base piece 1, which is explained in detail below.

FIGS. 2 to 10 show a schematic representation of a production sequence of a method according to the disclosure for producing a base piece 1 according to the disclosure, based on the individual stages of the base piece 1 during the method.

First, a metal wire can be provided and cut or trimmed to a certain length to form a cylindrical wire section 35 (FIG. 2). The wire section 35 is then set to form a thick-walled disk 37 (FIG. 3). A cup structure 39 with a central inner cavity 41, which can also be referred to as a case cavity, is then produced by extrusion (FIG. 4). The cup structure 39 is hereinafter referred to as the case blank 43.

Figure 6:
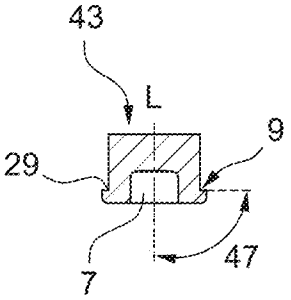

The case cavity 41 is then recessed further and then forms the primer receptacle 7 (FIG. 5). At the same time, the extraction groove 9 is preformed by deforming. Deforming is generally a non-cutting manufacturing process in which the base piece 1 is brought into a different shape without removing or adding material from the base piece 1; the mass of the base piece 1 remains the same during deforming. FIG. 5 shows that the preformed primer-side groove flank 28 of the preformed extraction groove 8 is oriented at an angle of less than 90° with respect to the longitudinal direction L of the base piece 1 or the case blank 43. The angle of inclination of the preformed groove flank 28 is indicated in FIG. 5 by the reference sign 45. In the next step, the preformed groove flank 28 is further deformed. FIG. 6 shows a completely deformed groove flank 29 after further deformation. It can be seen that this is oriented at an angle of 90° transversely to the longitudinal direction L, which is indicated in FIG. 6 by the reference sign 47.

Figure 8:
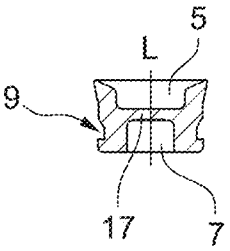
Figure 7:
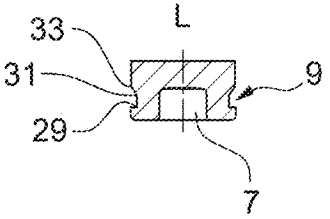

In the following two manufacturing steps, the desired inner and outer geometry of the base piece 1 is produced. First, the outer geometry is pre-pressed (FIG. 7). This produces the transition edge 33 of the extraction groove 9, which also forms the groove base 31. In the next step, the receptacle 5 for the case jacket 3 is pressed (FIG. 8). The base piece 1 is then calibrated (FIG. 9) and the web 17 is perforated so that a connection 27 is formed between the primer receptacle 7 and the receptacle 5 for the case jacket 3.

The schematic production sequence illustrates that in the production method according to the disclosure, the extraction groove 9 is introduced into the case blank 43 and completed (FIG. 6) before production of the receptacle 5 for the case jacket 3 is started (FIG. 8). This ensures that the high dimensional accuracy of the extraction groove 9 that can be achieved during deforming is not impaired by simultaneous or prior production of the receptacle.

FIGS. 11 to 18 show the production sequence from FIGS. 2 to 10 for producing a base piece 1 according to the disclosure with the associated tools.

Figure 13:
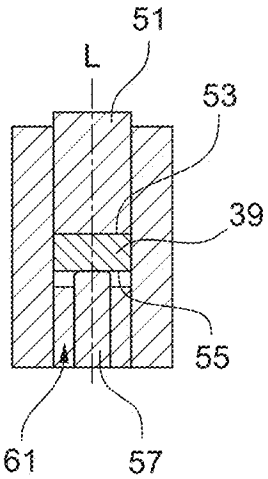
Figure 12:
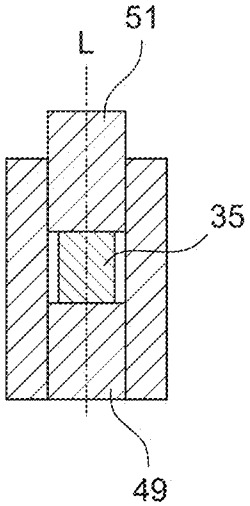
Figure 11:
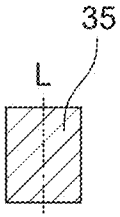

FIG. 11 again shows the cylindrical wire section 35 from FIG. 2, which is deformed into a thick-walled disk 39 in FIG. 12 with the aid of a die 49 for axially fixing the wire section 35 and a press plunger 51 movable in the longitudinal direction L. In FIG. 13, an upper side 53 of the thick-walled disk 39 is fixed by the press plunger 51, so that the case cavity 41 can be introduced from the lower side 55 of the thick-walled disk 39 by means of extrusion with a further press plunger 57.

Figure 14:
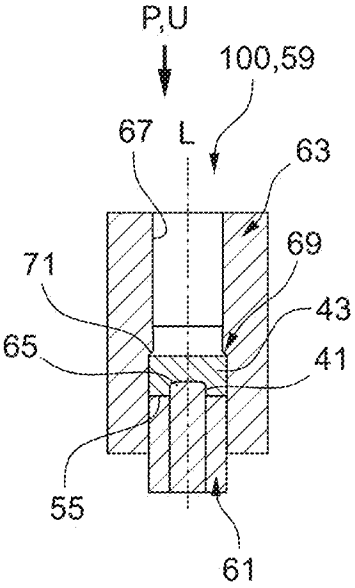

FIG. 14 shows the case blank 43 produced by the previous steps in a tool arrangement 100 according to the disclosure for preforming the extraction groove 9. The tool arrangement 100 may comprise a pair of preforming punches and dies 59 consisting of a preforming die 61 and a preforming punch 63 movable exclusively in the longitudinal direction L. The pressing movement direction P and thus the forming direction U thus run along the longitudinal direction L of the base piece 1 or the case blank 43. The pressing movement direction P and the forming direction U are each indicated by arrows in FIGS. 14 and 15.

In the exemplary production process in FIGS. 11 to 18, the press plunger 51 for introducing the case cavity 41 is also used as a preforming die 61 for preforming the extraction groove 9. For preforming the extraction groove 9, the preforming die 61 fixes the lower side 55 of the case blank 43 and engages with a central elevation 65 in the case cavity 41 of the case blank 43. The central elevation 65 centers the case blank 43 and fixes it in the radial direction. The preforming punch 63 is formed in a case-shaped manner and is circumferentially closed. The preforming punch 63 is also produced in one piece and surrounds the case blank 43 on the outside. The preforming punch 63 has a radially circumferential material displacement projection 69 on an inner side 67 facing the case blank 43. When the preforming punch 63 is moved towards the preforming die 61 in the longitudinal direction L, a groove flank 29 of the extraction groove 9 is preformed with the aid of the material displacement projection 69. As shown in FIG. 5, the preformed groove flank 28 is oriented at an angle 45 of less than 90° with respect to the longitudinal direction L (see FIG. 15). Accordingly, the material displacement projection 69 of the preforming punch 63 is also oriented at an angle of less than 90° with respect to the longitudinal direction L. In particular, a pressing surface 71 of the material displacement projection 69 can be oriented at an angle of inclination in the range from 10° to 80°, preferably in the range from 15° to 75°, in the range from 20° to 70° or in the range from 25° to 65° with respect to the longitudinal direction L.

FIG. 14 shows that the material is only displaced in the axial direction, i.e. along the pressing movement direction P or the forming direction U, when the preforming punch 63 moves along the longitudinal direction L of the case blank 43 towards the preforming die 61 during preforming of the extraction groove 9. No material is displaced radially outwards, as can be seen from a comparison of FIG. 14 and FIG. 15 by the fact that the outer diameter of the case blank 43 does not increase during preforming of the extraction groove 9.

Figure 15:
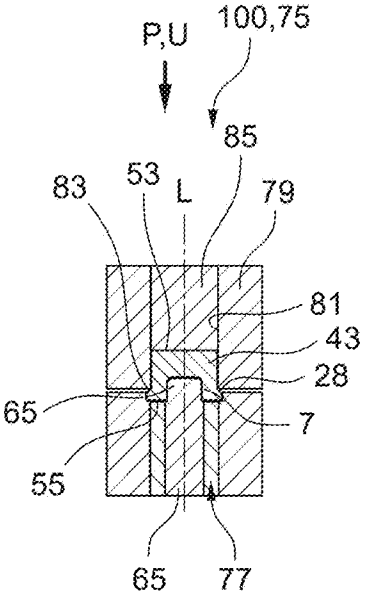
Figure 22:
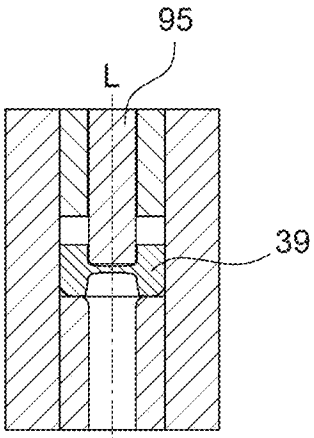
Figure 22:
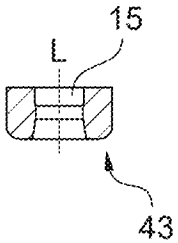
Figure 21:
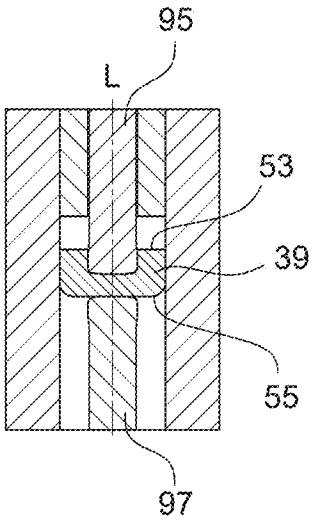
Figure 21:
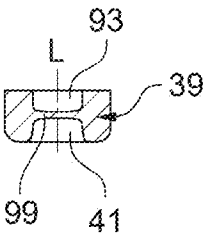
Figure 20:
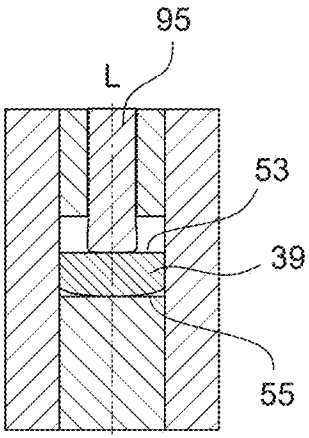
Figure 20:
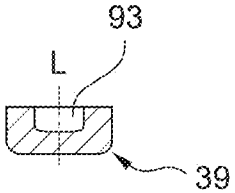

FIG. 15 shows a further tool arrangement 100 according to the disclosure, with which the preformed groove flank 28 is further deformed by means of backwards extrusion. In this context, backwards extrusion is to be understood as an extrusion process in which a material flow is generated against the forming direction U or against the direction of movement of the forming tool. The tool arrangement 100 may comprise a further punch and die pair 75 consisting of a die 77 and a press plunger 79. The die 77 in FIG. 15 is the same as the preforming die 61 in FIG. 14 with the only difference that the central elevation 65 is higher and thus the primer receptacle 7 has already been formed from the case cavity 41. For example, the central elevation 65 can be displaceable in the axial direction within the preform die 61 so that no additional die is required for further deforming of the preformed extraction groove 8 and costs and time can be saved during producing. The press plunger 79 is also formed in a case-shaped manner, wherein the lower side 83 of the press plunger 79 facing the case blank 43 can be regarded as a material displacement projection starting from an inner side 81 of the press plunger 79. When the press plunger 79 moves towards the die 77 in the longitudinal direction L, material is displaced so that a groove flank 29 is formed which, as in FIG. 6, is oriented at an angle of 90° transversely to the longitudinal direction L. In the embodiment shown in FIG. 15, the upper side 53 of the case blank 43 is additionally fixed by a further press plunger 85.

Figure 16:
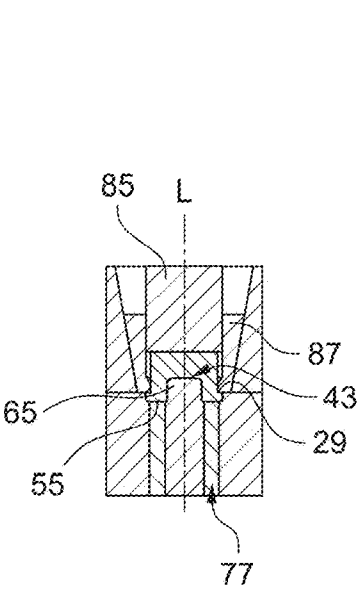

When simultaneously observing the producing step in FIG. 15 and the resulting stage of the case blank 43 in FIG. 16 with completely deformed extraction groove 9, it can be seen that the deforming of the preformed groove flank 28 to the finished groove flank 29 is accompanied by a material flow against the pressing movement direction P and the deforming direction U or the movement of the press plunger 79 along the longitudinal axis L of the case blank 43. As with the preforming of the extraction groove 9, however, there is no displacement of material radially outwards.

The tool arrangements according to the disclosure for deforming the extraction groove 9 shown in FIGS. 14 and 15 have a simpler structure compared to conventional tools and are therefore more cost-effective than conventional tools.

Figure 18:
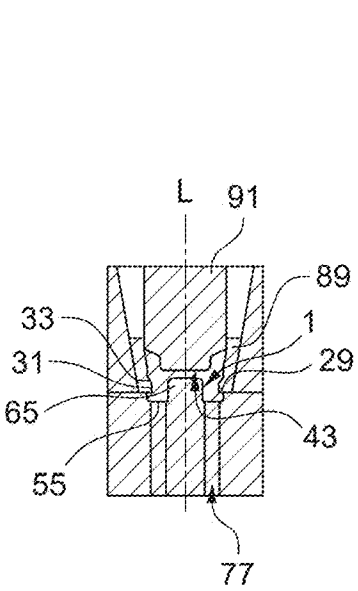
Figure 17:
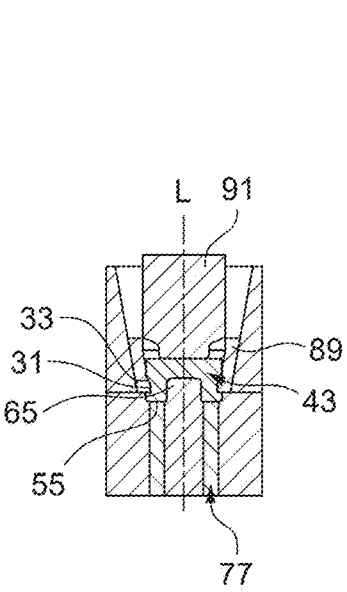

In FIGS. 16 to 18, the inner and outer geometry of the base piece 1 are then pressed. In FIG. 16, the transition edge 33 of the extraction groove 9 and the outer geometry of the receptacle 5 for the case jacket 3 are first pressed with a segmented tool 87, wherein the upper side 53 of the case blank 43 continues to be fixed by the press plunger 85 and the lower side 55 of the case blank 43 continues to be fixed by the die 77. In FIG. 17, the outer geometry is finish-pressed using a further segmented tool 89 and at the same time the inner geometry of the receptacle 5 is formed by a press plunger 91. The segmented tools 87, 89 can each consist of several stamping segments that move radially towards each other for deforming. Finally, FIG. 18 shows a finished base piece 1 in which only the through bore 27 still has to be introduced into the web 17 between the receptacle 5 and the primer receptacle 7.

FIGS. 11 to 18 show that the extraction groove 9 is not interfered with when producing the receptacle 5, so that the high dimensional accuracy of the extraction groove 9 is not impaired after deforming. It is also clear that no machining post-processing is necessary after the extraction groove 9 has been deformed. A further advantage of the production method according to the disclosure is that the transition between the groove flank 29 and the groove base 31 as well as the transition between the groove flank and the outer side 13 of the jacket 11 of the base piece 1 can be reliably formed at an angle of 90° (see FIG. 1).

FIGS. 19 to 26 show an alternative production sequence for a base piece 1 according to the disclosure with the tools used for this purpose, wherein the tool used is shown at the top in each of FIGS. 19 to 26 and the resulting stage of the base piece 1 or the case blank 43 is shown below. A producing base piece 1 is shown in FIG. 26 and differs from the base piece 1 in FIG. 1 or FIGS. 10 and 18 in that no web is provided between the receptacle 5 for the case jacket 3 and the primer receptacle 7.

Figure 19:
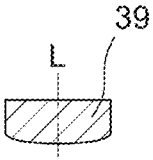

First, a blank 37 is punched out of a plate (FIG. 19). Alternatively, the blank 37 can also be pressed from a piece of wire as shown in FIGS. 2 and 3. Subsequently, a central inner cavity 93 is produced on an upper side 53 of the blank 37 by means of backwards extrusion (FIG. 20) by a press plunger 95, so that a cup structure 39 is formed. For this purpose, the press plunger 95 can be displaceable in a case-shaped guide 96 in the longitudinal direction L of the case blank 43. A lower side 55 of the blank 37 is fixed by a die 50. In the next step, a case cavity 41 is produced on the lower side 55 of the blank 37 by means of forward extrusion (FIG. 21) by a press plunger 97, so that a double cup structure 40 is formed. The case blank 43 is fixed in the axial and radial direction by the press plunger 95, which continues to engage in the inner cavity 93. A web 99 remains between the case cavity 41 and the cavity 93, which is then perforated using the press plunger 95 to produce a case blank 43, which is shown below in FIG. 22. The lower side 53 of the case blank 43 is held by a case-shaped die 98. The case blank 43 in FIG. 22 already has a continuous priming bore 15 through the annular jacket 11.

As in the manufacturing process in FIGS. 11 to 18, an extraction groove 9 is first preformed by deforming in the next step (FIG. 23). The tool arrangement 100 according to the disclosure essentially corresponds to the tool arrangement 100 in FIG. 14, so that reference is made to the embodiments of FIGS. 11 to 28 and only the differences are explained below. In the embodiment in FIG. 23, the die 61 does not have a central elevation for engaging in the central inner cavity 41 of the case blank 43 because the case blank 43 already has a continuous priming bore 15 and therefore cannot rest with the web on a central elevation. Instead, the case blank 43 is centered and radially fixed by the press plunger 95, which protrudes completely through the priming bore 15 of the case blank 43. In the next step, the preformed extraction groove 8 is further deformed (FIG. 24). The tool arrangement 100 according to the disclosure again essentially corresponds to the tool arrangement 100 of FIG. 15, with the difference that the case blank 43 continues to be centered and radially fixed by the press plunger 95. In FIG. 23, the press plunger 95 is held by the guide 96 and rests on the die 61 with one end facing the die 61. In FIG. 24, by contrast, the press plunger 95 is displaced further in the longitudinal direction L and is guided by the guide 96 and the die 77, which is formed in a correspondingly case-shaped manner. It should be understood that the die 61 can also be case-shaped in order to guide the press plunger 95 and that the die 77 does not necessarily have to be case-shaped, but that it is also possible that the press plunger 95 is only held by the guide 96 during further deforming (FIG. 24).

The inner and outer geometry of the base piece 1 are then pressed, in particular the transition edge 33 and the groove base 33 of the extraction groove 9 (FIG. 25) and the receptacle 5 for the jacket case 3 (FIG. 26) are formed by segmented tools 87, 89 and a press plunger 91, wherein reference is made to the embodiments of the production process in FIGS. 16 to 18.

In the alternative producing sequence, the extraction groove 9 is also introduced into the case blank 43 and completed (FIG. 24) before the production of the receptacle 5 for the case jacket 3 is started (FIG. 25). It can also be seen from FIGS. 24 and 25 that the extraction groove 9 is not interfered with when producing the receptacle 5 and that no post-machining of the extraction groove 9 is necessary.

FIGS. 27 and 28 show a direct comparison between a base piece 2 made of brass (FIGS. 27 and 29), which is common in conventional devices, and a base piece 1 made of brass according to the disclosure (FIGS. 28 and 30). In FIGS. 27 and 29, the reference signs for the individual elements of the base piece are each increased by 100.

In the conventional base piece 2, the extraction groove 109 was produced after producing the receptacle 5 for the case jacket 3 and in the base piece 1 according to the disclosure, the extraction groove 9 was produced by means of deforming before producing the receptacle 5 for the case jacket 3 by a purely axial deformation of the material. In both figures, the web 17, 117, which separates the receptacle 5, 105 for the case jacket 3 and the primer receptacle 7, 107, is not yet perforated.

It is clear from the comparison that the base piece 1 according to the disclosure has a higher degree of deformation. Particularly in the portion of the receptacle 5 for the case jacket 3 and in the portion of the extraction groove 9, it can be seen that the receptacle wall 25 and the priming bore wall 23 of the base piece 1 according to the disclosure have a higher degree of deformation. The degree of deformation is a measure of the deformation of the base piece 1. It indicates the extent to which the material is deformed when producing a base piece 1 from a wire section 35 or a disk 37. A higher degree of deformation guides to a higher strength and/or a higher hardness of the material. The hardness of the base piece 1 depends directly on the degree of forming. Due to the higher degree of forming and the resulting higher hardness of the base piece 1, higher holding forces can be achieved between the base piece 1 and the case jacket 3 as well as between the base piece 1 and the primer. As a result, a cartridge case 10 with a base piece 1 according to the disclosure can withstand greater internal pressures when the projectile is fired.

A base piece 1 according to the disclosure, which was manufactured using a method or tool arrangement 100 according to the disclosure, also has a characteristic hardness profile in the jacket 11 of the base piece 1, which thus indicates that the extraction groove 9 was manufactured using the method or tool arrangement 100 according to the disclosure.

In FIGS. 28 and 30 it can be seen that the degree of deformation on the groove flank 29 essentially corresponds to the degree of deformation on the groove base 31 and thus a homogeneous degree of deformation and thus a homogeneous hardness profile is present in the portion of the extraction groove 9. In contrast, the degree of deformation on the groove flank 29 is greater than the degree of deformation on the groove base 131 in the case of a base piece 2 in FIG. 27 or 29, which is common in conventional devices.

Furthermore, it can be seen from the lines 101 and 103, which run along the center of the wall thickness of the priming bore wall 23, 123 and the receptacle wall 25, 125, that the degree of deformation in the base piece 1 according to the disclosure increases continuously from the primer-side lower side 19 to the projectile-side upper side 21, which is not the case in the conventional base piece 2.

FIG. 31 illustrates a further exemplary embodiment of a tool arrangement 100 according to the disclosure, and FIG. 31 shows a perspective view of a section of the tool arrangement 100 with focus on the forming punch 115, which in the exemplary embodiment according to FIG. 31 comprises two punch halves 127, 129, which delimit between them a receptacle 131 which is round in cross-section and is concave, in particular hemispherical, in the other cross-sectional direction. Between the two punch halves 127, 129, anvil 107 is translationally movable relative to forming punch 115 in order to be able to come into abutment contact with forming punch 115 and to be movable away from forming punch 115 in the translational movement direction. FIG. 32 shows a perspective view of an exemplary embodiment of a base piece 1 according to the disclosure, which is produced by means of a tool arrangement 100, in particular according to the disclosure, which may comprise a forming punch comprising at least two punch parts. When producing the base piece 100 by means of the segmented tool, a separation point or seam 133 extending in the longitudinal axis direction of the base piece 1 and remaining on the outside 135 results as a narrow, elongated projection. The separation point 133 results from the material displaced during pressing of the base piece 1 by means of the segmented tools, which is located between the two stamp parts that are movable towards each other to perform the pressing movement, where the material is pressed and is visible as the seam 133. In the exemplary embodiment according to FIG. 32, the seam 133 extends essentially from the groove flank 129 to the upper side 21 of the base piece 1. However, the seam length of the seam 133 in the longitudinal direction of the base piece 1 can also be shorter and extend, for example, only up to about half the height of the receptacle wall 25 (see also, for example, FIG. 33). Furthermore, the depth or the shape of the seam 133 can vary transversely to the longitudinal extension, in particular in the radial direction. In this case, the seam depth in the portion of the groove flank 29 can be significantly less, in particular vanishingly less, than in the neighboring sections. This may be due to the fact that the groove flanks 29 are pressed with a closed, for example cylindrical, tool, so that no material displacement occurs which results in the formation of a seam. The seam depth can also decrease again towards the top in the portion of the base piece 1 that receives the case jacket 3, as this can be leveled out again during the joining of the base piece 1 with the case jacket 3 and by a calibration die, so that it is less pronounced in this area.

A varied shorter seam 133 is shown in FIG. 33, in which a base piece 1 is combined or joined to a case jacket 3. In particular in the portion of an upper joining section 137 of the base piece 1 facing the case jacket 3, the seam 133 can be smoothed out again after joining so that it is essentially not visible. Furthermore, as indicated in FIG. 33 by the different line thickness, the seam depth in the portion of the groove flank 29 can also be less pronounced, which is due to the previously described aspect of producing the groove flank 29 by means of a closed tool. This can also minimize any functional disadvantages of the seam 133. This is because a seam 133 on the outside 135 of the base piece can have a negative effect on the loading capacity under certain circumstances. A pronounced seam 133 in the portion of the groove flank could, under certain circumstances, have a negative effect on the essential extraction function of the extraction groove 9. With the method according to the disclosure, in which the extent of the seam 133 is deliberately controlled and reduced at the neuralgic, functionally relevant sections, the disadvantages from the conventional methods, namely pressing in extraction grooves with segmented tools, can be avoided.

The features disclosed in the above description, figures and claims can be of importance both individually and in any combination for the realization of the disclosure in the various embodiments.

REFERENCE LIST

1 Base piece
2 conventional base piece
10 Cartridge case
100 Tool arrangement
3 Case jacket
5,105 Receptacle
7,107 Primer receptacle
8 Preformed extraction groove
9,109 Extraction groove
11,111 Annular jacket
13 Outer side
15 Priming bore
17,117 Web
19,119 primer-side lower side
21,121 projectile-side upper side
23,123 Priming bore wall
25,125 Receptacle wall
26 Through bore
27 through bore
28 Pre-formed groove flank
29 Groove flank
31,131 Groove base
33,133 Transition edge
35 cylindrical wire section
37 thick-walled disk
39 Cup structure
40 Double cup structure
41 Case cavity
43 Case blank
45 Angle
47 Angle
49 Die (setting)
50 Die
51 Press plunger (setting)
53 Press plunger (case cavity)

55 Upper side
57 Lower side
59 Pair of preforming punches and dies
61 Preforming die
63 Preforming punch
65 Central elevation
67 Inside of punch
69 Material displacement projection
71 Pressing surface
75 Punch-die pair
77 Die
79 Press plunger
81 Punch inside
83 Material displacement projection
85 Press plunger
87 Segmented tool
89 Segmented tool
91 Press plunger
93 Central recess
95 Press plunger
96 Guide
97 Press plunger
99 Web
101 Line
103 Line
115 Forming punch
127,129 Punch halves
131 Receptacle
133 Separation point
135 Outer side
L Longitudinal direction
U Forming direction
P Pressing direction

The invention claimed is:

1. A method for producing a base piece adapted to receive a primer for a multi-part cartridge case, the method comprising:

producing, by deforming a blank, an extraction groove adapted to engage with a firearm ejector; and producing, by deforming the blank and after production of the extraction groove, a receptacle for a case jacket of the multi-part cartridge case adapted to receive a projectile.

2. The method according to claim 1, wherein production of the receptacle excludes an engagement with the extraction groove.

3. The method according to claim 1, further comprises forming a primer-side groove flank of the extraction groove by causing a material displacement directed in a longitudinal direction of the base piece without material being displaced radially outwards.

4. The method according to claim 3, wherein producing the extraction groove comprises a material flow being directed against a forming direction of a movement of a deforming tool used to deform the blank.

5. The method according to claim 4, wherein the primer-side groove flank of the extraction groove is formed, using a pair of preforming punches and dies, such that the primer-side groove flank is inclined at an angle of less than 90° with respect to the longitudinal direction of the base piece.

6. The method according to claim 5, further comprising: further deforming, by backwards extrusion using a second pair of punches and dies, the extraction groove.

7. The method according to claim 1, wherein the extraction groove is produced without a machining post-processing operation.

8. The method according to claim 1, wherein the deforming of the blank comprises cold forming.

9. The method according to claim 8, wherein the cold forming comprises impact extrusion.

10. The method according to claim 1, wherein the extraction groove is formed using a circumferentially closed press plunger.

11. The method according to claim 1, wherein the extraction groove is free of material flags in a circumferential direction.

12. The method according to claim 1, wherein, during production of the receptacle, the extraction groove is free of engagement.

13. The method according to claim 1, wherein forming the extraction groove comprises displacing material in an axial direction without increasing an outer diameter of the blank.

14. The method according to claim 1, wherein the extraction groove comprises a groove base oriented in the longitudinal direction of the base piece.

15. The method according to claim 1, wherein the extraction groove is formed such that a primer-side groove flank is oriented transversely to a longitudinal direction of the base piece.

16. The method according to claim 1, wherein a hardness of the blank at a primer-side groove flank of the extraction groove deviates from a hardness at a groove base of the extraction groove by less than 40%.

17. The method according to claim 16, wherein the hardness at the primer-side groove flank deviates from the hardness at the groove base by less than 10%.

18. The method according to claim 1, further comprising producing an internal geometry of the base piece by punching.

19. The method according to claim 1, wherein the receptacle is formed to open into a priming bore of the base piece.

20. The method according to claim 1, further comprising forming a seam or separation point on an outside of the base piece based on the deforming of the blank to produce the extraction groove and/or the deforming of the blank to produce the receptacle.

* * * * *